US005959237A

United States Patent [19]

Clement

[11] Patent Number: 5,959,237

[45] Date of Patent: Sep. 28, 1999

[54] EXPLOSIVE CHARGE WITH ASSEMBLED SEGMENTS AND METHOD OF MANUFACTURING SAME

[75] Inventor: Roger B. Clement, Spanish Fork, Utah

[73] Assignee: The Ensign-Bickford Company, Simsbury, Conn.

[21] Appl. No.: 08/521,930

[22] Filed: Aug. 31, 1995

[51] Int. Cl.[6] ..... F42B 3/00; C06B 5/06

[52] U.S. Cl. ..... 102/317; 102/331; 102/288

[58] Field of Search ..... 102/317, 288, 102/289, 331

[56] References Cited

U.S. PATENT DOCUMENTS

| | | | |
|---|---|---|---|
| 3,224,191 | 12/1965 | Bratton | 60/35.6 |
| 3,296,794 | 1/1967 | Nash | 60/39.47 |
| 3,316,842 | 5/1967 | Schultz | 102/100 |
| 3,604,353 | 9/1971 | Newman et al. | 102/24 |
| 3,619,305 | 11/1971 | De Brancion | 149/2 |
| 3,721,192 | 3/1973 | McEwan et al. | 102/24 HC |
| 3,756,025 | 9/1973 | McCullough | 60/255 |
| 3,773,573 | 11/1973 | Slykhouse | 149/21 |
| 3,779,819 | 12/1973 | Thomas et al. | 149/2 |
| 3,822,645 | 7/1974 | Alexander | 102/102 |
| 3,880,080 | 4/1975 | Cook | 102/24 R |
| 3,994,756 | 11/1976 | Hendrickson, Sr. et al. | 149/18 |
| 4,094,248 | 6/1978 | Jacobson | 102/100 |
| 4,293,351 | 10/1981 | Johannes | 149/19.2 |
| 4,678,524 | 7/1987 | Cranney et al. | 149/21 |
| 4,696,233 | 9/1987 | Paxton | 102/287 |
| 4,747,892 | 5/1988 | Spencer | 149/20 |
| 4,776,276 | 10/1988 | Yunan | 102/275.5 |

OTHER PUBLICATIONS

Cedric Errol Gregory, *Explosives for North American Engineers*, (Clausthal–Zelterfeld, Federal Republic of Germany: Trans Tech Publications; Houston: Gulf Pub. Co., 1984), pp. 178–181.

Josef Kohler and Rudolf Meyer, *Explosives*, (New York: VCH Publishers, 1993), pp. 34–35, 70–73, 92–93, 264–265, 270–273 and 370–373.

*Primary Examiner*—Peter A. Nelson
*Attorney, Agent, or Firm*—Trask, Britt & Rossa

[57] ABSTRACT

An improved cast explosive charge and a method of manufacturing said cast explosive charges utilizing an automated assembly system. The explosive charges are produced by combining two elongate cast segments, thereby abutting an exterior surface of one segment, formed by explosive material into an exterior surface of a second segment formed by explosive material, and attaching the cast segments together with wrapping material. The cast explosive charge produced by this method of manufacturing exhibits a markedly improved detonation velocity.

33 Claims, 10 Drawing Sheets

EXPLOSIVE CHARGE WITH ASSEMBLED SEGMENTS AND METHOD OF MANUFACTURING SAME

BACKGROUND OF THE INVENTION

1. Field of the Invention

The present invention relates generally to explosives, and specifically to high-energy explosive primer charges. More particularly, the present invention relates to an improved primer charge of cast explosive and method of manufacturing thereof.

2. Description of Related Art

A complete explosive assembly typically comprises a high-explosive main charge, a primer (or booster) charge, and a primary initiator. The primary initiator, typically a blasting cap, electric detonator, or Low Energy Detonating Cord (LEDC), is used to initiate the primer charge. The high-explosive, such as Ammonium Nitrate Fuel Oil (ANFO), is typically insensitive to the primary initiator and requires initiation by the primer charge. Primer charges are typically formed into cylindrical casts, having one or more bores therein for the insertion of the primary initiator. However, bores are not necessary since blasting caps can be taped to the exterior of the explosive charge. Primer charges are also frequently used by themselves as the total explosive charge.

Cylindrical cast primer charges are well known in the art. Various compositions and properties of cast explosive charges are described in, for example, U.S. Pat. No. 3,994,756 issued Nov. 30, 1976, to Hendrickson et al.; U.S. Pat. No. 4,678,524 issued Jul. 7, 1987, to Cranney et al.; U.S. Pat. No. 4,747,892 issued May 31, 1988, to Spencer; and U.S. Pat. No. 4,776,276 issued Oct. 11, 1988, to Yunan, which are hereby incorporated herein by reference.

Primer charges are typically formed into cast compositions from pourable mixtures, such as Pentolite or Cyclotol. Pentolite, a mixture of Pentaerythritol tetranitrate ("PETN") and Trinitrotoluene ("TNT"), is typically mixed in a weight ratio of from 60/40 to 40/60. Cyclotol is a mixture of Cyclonite ("RDX") and TNT, which is typically mixed in weight ratios of from 50/50 to 75/25. Small amounts of other constituents, such as wax, cellulosic resins, metallic particles, or curable plastics may also be utilized in varying proportions to effect desirable physical and chemical properties of the cylindrical cast charge. Other castable explosive compositions include Amatex, Kalatol, Tritonal, Tetrytol, Baratol and Baronal.

The casts are generally prepared by stirring powdered solid components, such as PEIN or RDX (which are essentially insoluble in water and have a higher melting point than TNT), or mixtures thereof, with molten TNT until a homogeneous slurry is obtained. The molten slurry, typically at temperatures exceeding 100°C., is then poured into upright cylindrically-shaped molds or canisters (made of cardboard, plastic, or the like), wherein the molten slurry is allowed to cool and solidify into cylindrical cast primer charges.

Generally, each of the canisters is positioned about a pair of upstanding pins prior to the introduction of the slurry in the canister. After cooling, the entire canister or mold, containing the solidified explosive is pressed off of the pins, leaving the bores extending through the charge.

Present manufacturing processes typically require an individual worker to manually pour the molten mixture into the upright cylindrical canisters. Once the mixture has solidified, the worker must remove the pair of upstanding pins (used to form the bores through the cast primer charge) and tapping the pins out of the canister. The cylindrical primer charge produced by this process is a single-piece casting.

In some manufacturing processes, machines are used to press the solidified explosive off of the pins. In one example, hydraulic presses may be used to press the pins out of the canisters. In some processes, a number of pins may be physically joined together to form a pin bar. Each pin bar may contain several pairs of pins. In this particular approach, several primers are fabricated using each pin bar arrangement.

There are significant safety concerns associated with labor intensive manufacturing facilities, particularly in the production of explosives. Quality control is also difficult to maintain in such environments. Furthermore, the explosive products are becoming increasingly more expensive to produce. This increasing cost reflects the costs of labor, materials, and accompanying problems associated with production. In particular, pentolite and cyclotol are expensive; and although mixtures comprising pentolite and cyclotol are highly desirable from a chemical standpoint, they are often disadvantageous from an economic standpoint.

One of the principal parameters used to compare explosive properties is the rate of detonation ("ROD"), which is the velocity at which the explosive burns. The higher the ROD, the higher the shattering effect of the explosive. Aside from having a higher shattering effect, a higher ROD is desirable from a timing standpoint. For instance, in quarries and open pit mining, it is typically to drill row after row of holes which are charged with explosive and then detonated from front to back in a timed sequence. If one row detonates too fast or too slow the desired effect (uniform stone cleavage or earth removal) will not take place. Thus, it is imperative that the rate of detonation be consistent. Therefore, a consistent higher rate of detonation would lessen or eliminate timing errors.

In commercial explosives, the ROD ranges from approximately 5,000 to 30,000 feet per second (fps). Although the ROD of an explosive charge depends on the density, particle size, and degree of confinement, the ROD of previous cast compositions typically ranges from 27,000 to 30,000 fps. The highest recorded rates of detonation have been in the 34,000 feet per second range.

In view of the foregoing, it would be advantageous to produce a primer charge with a consistent high ROD. It would also be advantageous to have a less-expensive and safer method for manufacturing process for primer charges.

SUMMARY

The present invention relates to cast explosive charges and a method for manufacturing same. The cast charges have enhanced explosive characteristics, including higher detonation velocities than previously available. The manufacturing method includes a system of molds for shaping molten slurry into cast segments upon solidification. The cast segments are then combined to form cast explosive charges. Although cylindrical explosive charges are extensively described herein, it should be understood that a variety of non-cylindrical explosive charge configurations are possible utilizing the instant invention, e.g., rectangular box-shaped, spherical, coneshaped, etc.

The improved cast explosive charges are formed from at least two cast segments. Two or more cast segments are secured one to another to form an explosive charge. In each explosive charge, a solid, inelastic surface of a first segment, formed by the actual explosive material of that first segment, is physically abutted against a solid, inelastic surface of a second segment, formed by the actual explosive material of that second segment. The abutment of the two surfaces forms an interface between the two segments. Being that the two abutting segment surfaces are solid members having less than perfect planar surfaces, the abutment of the two segments one against the other defines a number of locations over the general surface of the interface wherein the segments do not actually touch one another. These locations define air-filled channels or pathways between the opposing segment surfaces. There exists a significant number of air-filled pathways or channels formed at the interface which extend significant distances through or over the surface of the interface. Many of these air-filled pathways communicate with the perimeters of the interface. Some of these pathways may communicate one perimeter of the interface with another perimeter of the interface. It follows that many of these pathways extend across the full width and/or the full height of the interface. Furthermore, these pathways may, therefore, extend across the full height, the full width and/or the full depth of the explosive charge itself. In those instances wherein the explosive charge defines a diameter, the interface may define pathways which extend diametrically through the entire explosive charge.

The abutting surfaces of the cast segments may be textured or otherwise configured during their manufacture to vary the size, quantity and/or configuration of the pathways formed upon the abutment the cast segments during the construction of the completely assembled explosive charge. The interface may be oriented parallel to the longitudinal axis, the latitudinal axis or an axis oriented transverse of the longitudinal axis of the explosive charge.

In one construction, each cast segment has at least one surface which is capable of substantially flush engagement with at least one surface of another cast explosive segment. The cast segments are arranged such that at least one surface of each cast explosive segment is adjacent to and in substantially flush engagement at least one surface of another cast explosive segment.

The instant explosive charge configuration results in dramatically improved explosive characteristics. Although the actual physical mechanism is not known to the applicant, the minute pathways or channels between the engagement of the segments of a explosive charge are believed to profoundly increase the ROD of the charge when compared to a single-piece explosive charge of the same size and composition. For example, one embodiment of the improved cast charge, formed from two elongate cast segments, exhibits a surprising improvement (approximately 30%) in ROD over previous single-piece explosive charges.

In accordance with the manufacturing method of the present invention, casting molds having cavities formed therein are provided for receiving a molten slurry, typically containing a mixture of TNT and other chemicals. In the preferred embodiment, the cavities are semi-circular in cross section and elongate, wherein the length of the cavity is approximately 4 to 8 times the radius (maximum depth) of the cavity. The cavity may, however, be of any suitable size or shape, such as rectangular, cubic, or elongate with an oval or triangular cross section. The cast molds are preferably made from flexible material, such as rubber, plastic, or the like. In the preferred embodiment, a silicone material is utilized such as Silastic T-RTV™ Silicone Rubber which may, at present, be purchased from Dow Corning.

It is understood that alternative embodiments of the manufacturing method may entail filling the casting molds in an orientation wherein the longitudinal axis of molded segment is oriented in horizontal or vertical orientation. By way of example, three equal-sized segments may be produced in accordance with this embodiment.

A dispensing means is provided for pouring the desired amount of molten slurry into the casting mold cavity. The casting mold may contain a wide variety of features to manipulate the shape of the cast segment produced therein. For example, indicia (such as hatch marks, identifying material, or a manufacturer's logo) may be formed directly into or onto one or more of the surfaces of the cast segment. A cast charge with tapered ends or indentations, for example, may also be produced with minor modifications to the cast mold. Further, other casting configurations may be adopted to achieve specific cast configurations.

In the preferred embodiment, an upper mold is provided. The upper mold is generally slab shaped, although the top (non-contacting) surface of the upper mold is essentially immaterial. Preferably, the upper mold is formed from the same material as the cast mold, although a wide variety of flexible or inflexible materials may be suitable, such as rubber, plastic, composites, or the like. After the cavities of the casting molds have been filled to the desired level with molten slurry, the contact surface of the upper mold engages the cast mold such that the upper mold is in contact with the molten slurry. In this manner, a variety of features can easily be formed into, or onto, the upper surface of the cast segment. In many embodiments, the upper surface of the cast surface will form the segment surface which is abutted against the abutment surface of another segment to form an explosive charge. It follows that the upper mold may be used to texture or otherwise configure the upper segment surface to form the pathways or channels hereto before described.

The molten slurry, confmed between the cast mold and upper mold, is then cooled sufficiently until the molten slurry solidifies into a suitable solid, inelastic cast segment. In a particularly suitable embodiment, a cooling chamber is provided for facilitating the solidification process. In the preferred embodiment, the upper molds engage with the cast molds prior to entering the cooling chamber, so as to avoid premature hardening of the molten slurry before the upper mold engages the molten slurry. It is understood, however, that the upper molds may, in appropriate circumstances, engage the cast molds inside a cooling chamber.

Once the cast segment is sufficiently cool, the upper mold is removed from the cast mold and cast segment. The cast segment is then ejected from the cast mold, and, in the preferred embodiment, two half-cylinder cast segments are subsequently combined to form a single cylindrical cast explosive charge.

It is understood, however, that a wide variety and number of different sized and shaped segments may be used to form a cylindrical cast explosive charge whereas two segments have presumably been described as forming an explosive charge. It should be understood three or more segments could be secured to one another to form an explosive charge. In one alternative embodiment, two different-shaped sets of molds may be used, wherein one set of molds produce a center segment, and the other set of molds produce the two identically-shaped end segments, which sandwich the center segment to form a cylindrical cast charge.

In other alternative embodiments, only one set of molds are used, as in the preferred embodiment, but which include a thin axial divider wall formed lengthwise in the cast mold cavity. In this way, a suitable (even) number of segments may be produced to form a cylindrical charge. In other alternative embodiments, thin non-axial dividers may be used to divide the cast segments lengthwise or widthwise into any suitable number of smaller or shorter segments, respectively. It should be clear that the manufacturing method of the present invention provides great flexibility in the design of cylindrical cast charges.

Mating means may be formed into each cast segment. In the preferred embodiment, each upper mold has two semi-spherical male nodules, and two semi-spherical female recesses, thereby forming semi-spherical features into and onto, respectively, each cast segment. These features are positioned such that each male nodule engages with each female recess upon combining the cast segments into a single cylindrical charge. These features ensure proper fitting of the cast segments, and prevent lateral or sliding movement of one cast segment with respect to the other cast segment combined therewith.

It is understood that a wide variety of mating means may be employed, but may not need to be used all the time, especially in small primer charges where there may little surface area. Additionally, the male nodule or peg (and corresponding female recess) may be of any suitable shape, as long as each male nodule engages with a correspondingly positioned female recess. Suitable nodule (and recess) shapes also include: disks, cylinders, squares, stars, triangles, rectangles, crosses, and the like, as well as any combinations thereof. Alternative embodiments utilize varying numbers of nodules and corresponding recesses, depending in part on the size of the nodules and recesses. Other embodiments utilize the nodules and recesses in various positions on the cast segments.

The amount of molten slurry dispensed into the cast mold cavities should approximate the volume of the cavity in the cast mold, minus the displaced volume of any protruding features on the upper mold, plus the volume of any recesses in the upper mold.

In one embodiment, the upper mold forms hatch marks on the flat surface of the cast segment. It is believed that such marks positively affect the explosive properties of the cast explosive charge. Hatch marks may be formed of recesses or protrusions. In one embodiment, the recessed hatch marks of one cast segment engage the protruding hatch marks of another cast segment upon combining them into a cylindrical charge. Varying patterns of hatch marks may be produced with only minor modification to the upper mold. In alterative embodiments, the hatch marks may be produced by scoring the solidified cast segments by hand or machine tools.

In the preferred embodiment, the upper mold includes two elongate protrusions, semi-circular in cross section, thereby forming two channels in the cast segment. Once the cast segments are combined, the two channels of one segment align with corresponding channels of another segment to form two circular bores in or through the cylindrical charge. The channels formed in the cast segments (and corresponding bores formed in the cylindrical charge) may be of any suitable diameter or length. Generally, the bores are sized to accommodate a blasting cap or detonating cord. In one embodiment, the diameter of the bores through the cylindrical charge are approximately 5/16 inches, and the bores extend through the entire length of the charge.

It is understood that any appropriate number of bores may be formed, such as one, three, or more. There may also be a single bore with different or varying diameters. Furthermore, the bores need not be in the center or even along a diameter of the cylindrical charge. In fact, the bore can be a channel on the exterior surface of the charge. Of course, bores are not necessary since blasting caps can be taped to the exterior of the explosive charge.

In particularly suitable embodiments, the cast molds are placed on an automated conveyor assembly having a horizontal surface such that the longitudinal axis of the mold cavity is parallel with the horizontal surface of the conveyor assembly. In the preferred embodiment, the molten slurry is dispensed by an automated filling mechanism capable of repeatedly dispensing the appropriate quantity of molten mixture desired. The excess mixture can be squeezed out as the two mold halves come together, ensuring the proper fill, so the automated filing mechanism does not have to be precise.

In one embodiment, the upper molds are attached to a conveyor assembly such that the upper mold will operationally engage the cast mold. The cast (and upper) molds may be spaced apart from each other on the conveyor assembly. In the preferred embodiment, however, the cast (and upper) molds are placed adjacent one another in a continuous assembly. In this way, there is a first conveyor assembly having a continuous supply of cast molds, and a second conveyor assembly having a continuous supply of upper molds.

In one particularly suitable embodiment, the cast and upper molds are fed along their respective conveyor assemblies in groups of ten abreast, whereby the molten slurry is dispensed into ten mold cavities simultaneously or in series, before proceeding to the next group of ten molds; however, any suitable number of molds may be placed abreast one another.

Once the upper mold disengages from the cast mold, and once the cast mold ejects the cast segment, the respective molds return on their respective conveyor assemblies to be used again. In one embodiment, the molds are rinsed, cleaned and lubricated prior to subsequent use.

The improved cylindrical charge is formed from an assembly of individual cast segments, produced by any suitable manufacturing method. The cast segments may then be attached together by various means so as to hold the abutting surfaces of adjacently positioned segments in abutment. In the preferred embodiment, shrink wrap is used to wrap the cylindrical charge, thereby sealing the cast segments together. The shrink wrap (typically formed from cellophane, plastic, or other suitable material) can be used to substantially encase the cylindrical charge. In the preferred embodiment, the shrink wrap does not cover or interfere with any bores formed in the cylindrical charge.

Other suitable means for attaching the cast segments together are envisioned, including tape, end caps, bands, adhesive, tubing, containers, string, pre-made labels, textile material, coatings, adhesive, or any combination thereof. In one embodiment, the charge is sealed in shrink wrap and fitted with cardboard or plastic end caps. In another embodiment, the charge is fitted first with cardboard or plastic end caps. This alternate embodiment may then be sealed with shrink wrap or wrapped with a label.

It is understood that the cast segments may be fitted with attachment means at various stages in the manufacturing method. In one embodiment, the cast segments are collected and combined together after being ejected from the cast molds, and before being fitted with shrink wrap. In an alternative embodiment, a wrapping is set inside the cast mold cavity of one or more of the cast segments prior to the introduction of the molten explosive composition into that cavity. During the casting process, the explosive material may actually bond to the wrapping.

The cast explosive charges formed from individual cast segments exhibit improved explosive characteristics. Although the details of this phenomenon are not entirely understood, the improved charges exhibit surprisingly high increases in detonation velocity. In preliminary testing, the improved charges have demonstrated detonation velocities of up to 39,123 fps. This represents an increase in ROD of about 30%.

The improved cylindrical cast charge of the present invention may be manipulated to achieve various detonation velocities, thereby obtaining a variety of explosive properties, without introducing major variations in the manufacturing method.

Furthermore, the manufacturing system described, with a one inch per second feet rate on the conveyor belt, and 10 cavities wide each row, should produce five primer charges approximately every four seconds with equates to 75 primer charges every minute or 4500 primer charges every hour. Total production of 16 oz. primers in 24 hours would be 108,000 units. This is a two and half fold increase in the production capabilities of present manufacturing facilities.

This production increase is the result of the elimination of the time consuming task of manually setting up the canisters on the pin bars and rolling the tables of pin bars in and out of the coolers. The manufacturing system also eliminates the human labor it takes to press the case primer charges off of the pins.

BRIEF DESCRIPION OF THE DRAWINGS

While the specification concludes with claims particularly pointing out and distinctly claiming that which is regarded as the present invention, the features, and advantages of the present invention may be ascertlined with reference to the following description, in conjunction with the accompanying drawings, in which:

DETAILED DESCRIPTION OF THE ILLUSTRATED EMBODIMENT

Figure 1:
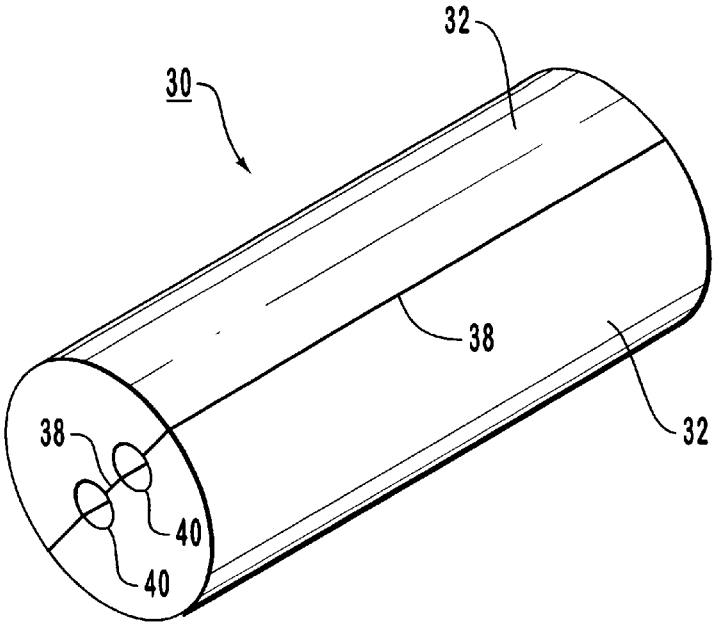
FIG. 1 is a perspective view of the cylindrical cast explosive charge.
Figure 2:
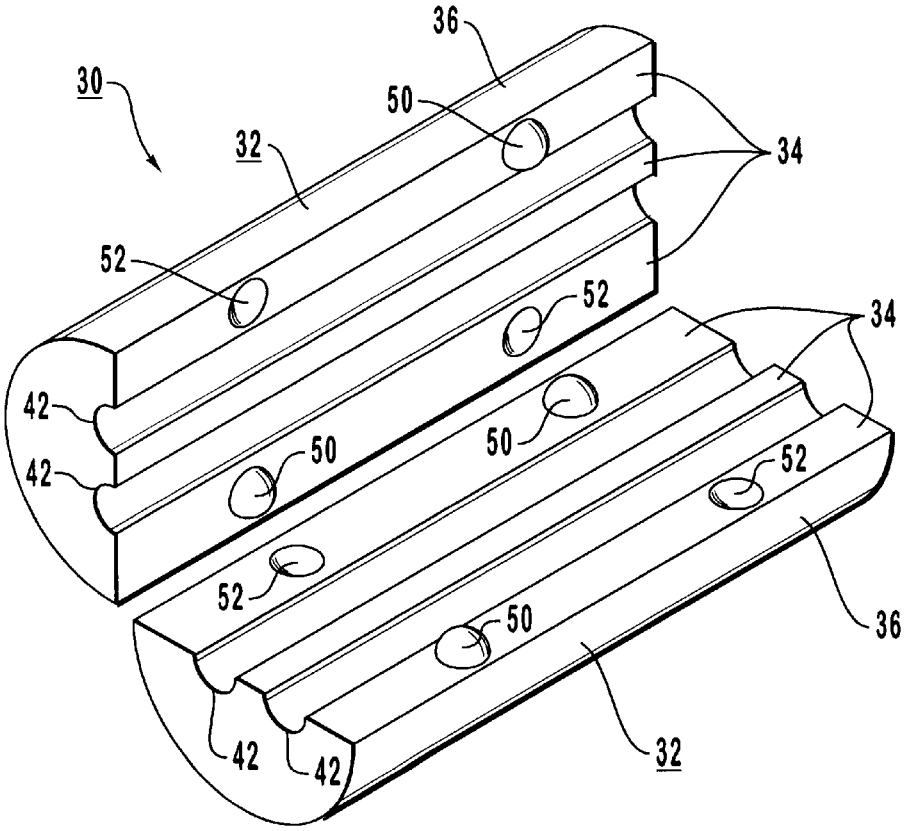
FIG. 2 is a perspective view of the cylindrical cast explosive charge of FIG. 1, illustrating the individual elongate segments.

Referring to the drawings and FIG. 1 in particular, the cylindrical charge 30 is composed of two identical elongate cast segments 32. The two cast segments 32, which are substantially semi-circular in cross section, fit together as shown in FIG. 2, to form the cylindrical charge 30. Each cast segment 32 has a flat surface 34 and a curved surface 36. The two cast segments 32, when properly combined together, contact each other along the flat surfaces 34, defining an interface or joint 38 (see FIG. 1) which extends along a diameter of the cross section of the cylindrical charge 30 as well as over the full height of the charge 30. Each of the cast segments 34 are solid elements each presenting a solid, inelastic abutment surface. Owing to the less than perfectly planar configuration of surfaces 34 when the two surfaces 34 are abutted one against another, there are defined at the interface of the 5 two surfaces 34 a number of air-filled voids, pathways and channels 35 due to the texture of the abutment surfaces 34. The channels 35 may extend from one side 37A to the other side 37B of the charge 30. Further other channels 35 may extend from the bottom 39A to the top 39B of the charge 30.

Figure 6:
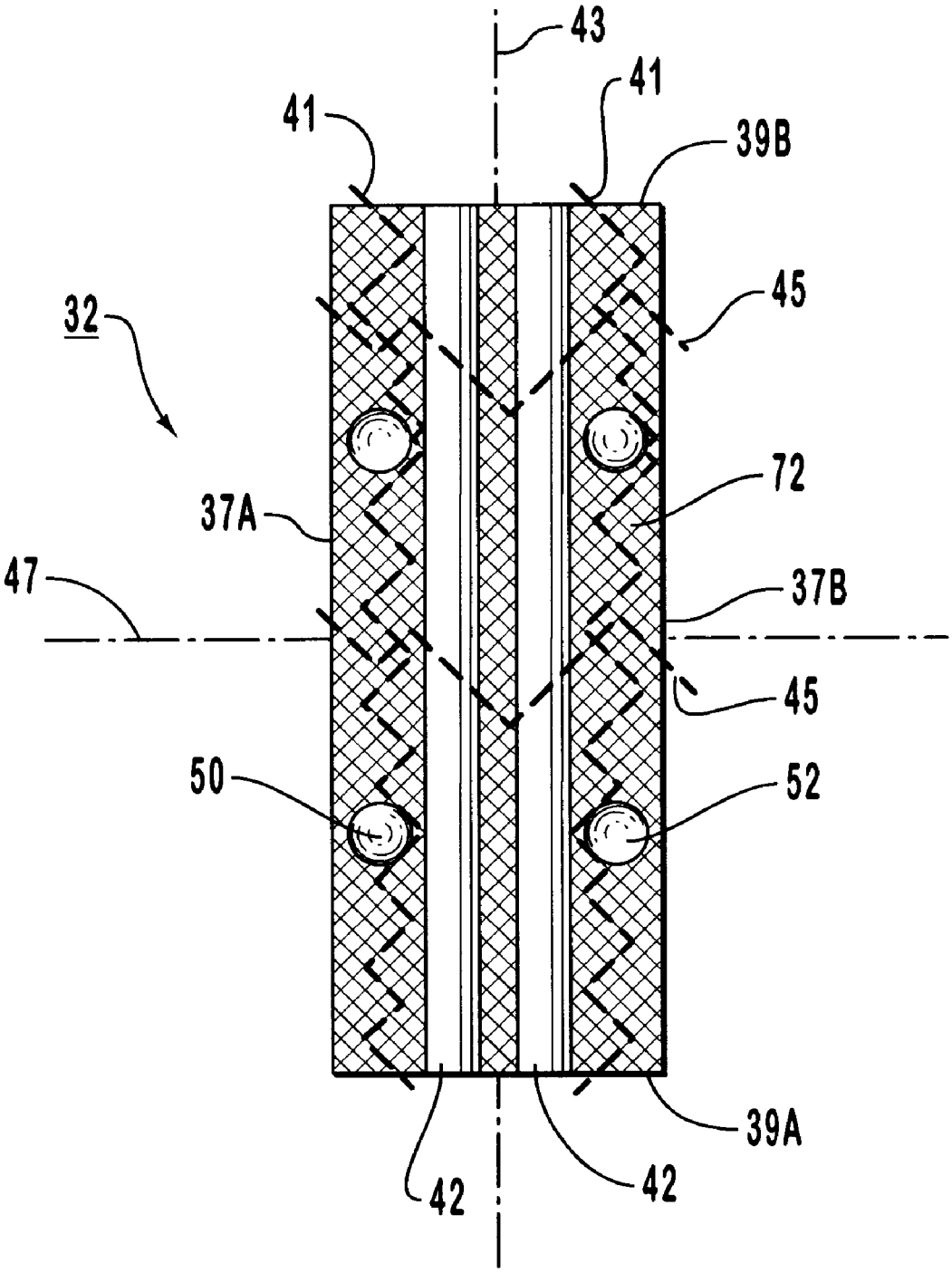
FIG. 6 is a top view of an alterative embodiment of the cast explosive charge segment, illustrating hatch marks formed thereon.

As shown in FIG. 6, wherein the surface 34 has been configured to include a series of indentations 39 which form a cross-hatching arrangement. An association of several of the indentations 39 defines a number of channels 41. Some of these channels extend generally parallel to the longitudinal axis 43 of the segment, through the full height of the segment. Further, a number of channels 45 extend generally parallel to the latitudinal axis 47 of the segment generally through the width of the segment. Notably channels 45 extend across the full diameter of the explosive charge and may be considered as extending through the full width or depth of the charge.

Two bores 40, of circular cross section, extend through the cylindrical charge 30. The bores 40, located along the joint 38 and at a common predetermined distance from the cylindrical axis (not shown), are generally used for the insertion of a primary initiator (not shown), such as LEDC or blasting caps. The bores 40 are formed from two channels 42, illustrated in FIG. 2, which are semi-circular in cross section and extend the length of the cast segments 32. Each channel 42 of the cast segment 32 complements the corresponding channel 42 in the cast segment 32 which is to be combined therewith, to form the cylindrical charge 30.

It is understood that, consistent with the present invention, any suitable number and size of bores 40 may be formed in or through the cast segment 32. The bores 40 need not be located along the joint 38, and different sized bores 40 may be formed within or through the same cast segment 32.

Each cast segment 32 has two semi-spherical male nodules 50, and two semi-spherical female recesses 52. One each of the male nodules 50 and the female recesses 52 are positioned on each side of the channels 42. In combining the cast segments 32, the male nodules 50 of one cast segment 32 matingly engage with the corresponding female recesses 52 in the cast segment 32 which is to be combined therewith.

In accordance with the present invention, it is understood that the cast segments 32 may have a wide variety of shapes and sizes of both male nodules 50 and female recesses 52, if any, for mating with each other upon combining the cast segments 32 together. The male nodules 50 and female recesses 52 may be formed on any suitable position, and in any effective orientation, on the flat surface 34 of the cast segment 32.

Figure 3:
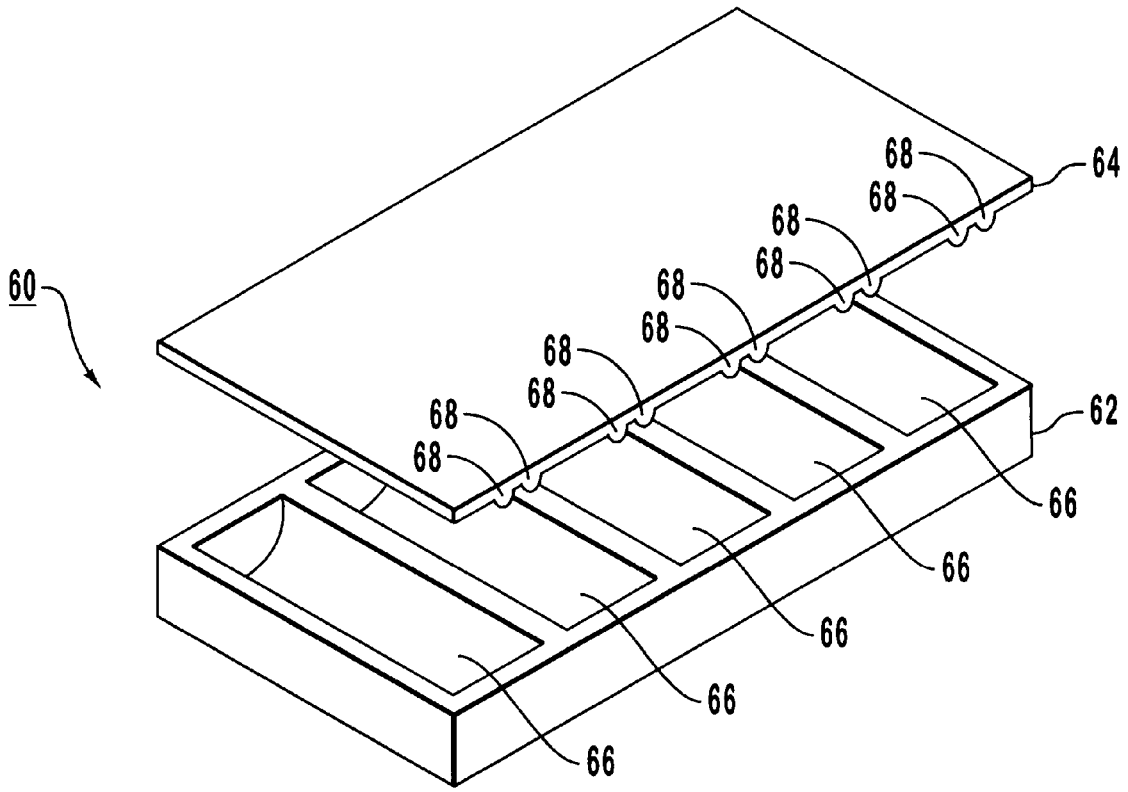
FIG. 3 is a perspective view of the set of cast and upper molds, illustrating how the features of the molds line up relative to each other.
Figure 4:
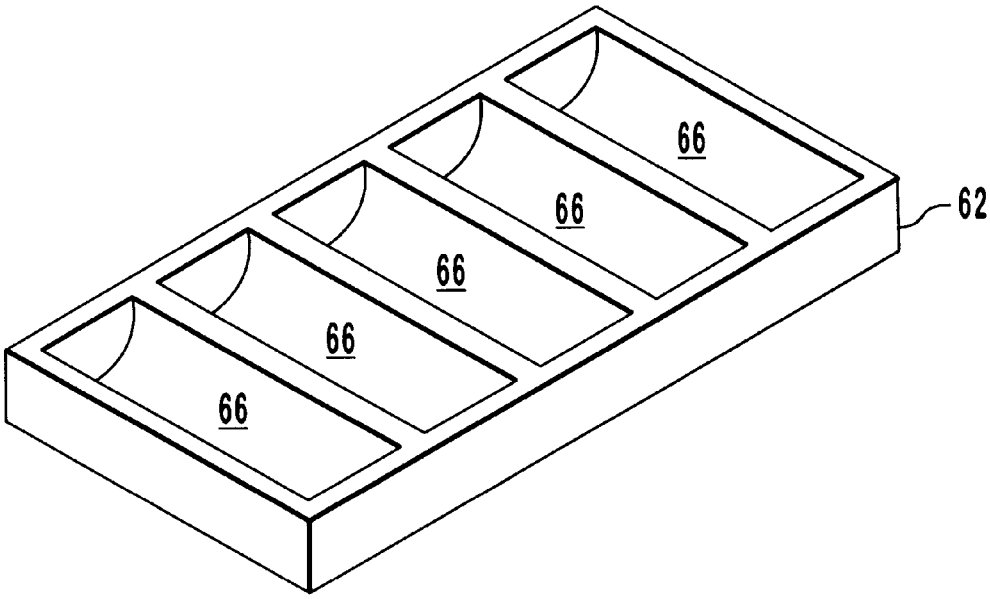
FIG. 4 is a perspective view of the cast mold illustrating the elongate cavities formed therein.

Referring to FIG. 3, an improved method of manufacturing the cylindrical charge 30 utilizes a set of molds 60. It is understood, however, that a single mold (not shown) may also be used. The set of molds 60 are preferably formed from flexible material, such as rubber, plastic, or suitable composite (e.g., silicone, polyethylene, or polypropylene). The set of molds 60 include a (lower) cast mold 62 (see FIG. 4) and an upper mold 64 (see FIG. 5). The cast mold 62 has at least one elongate cavity 66 formed therein. In the preferred embodiment, the maxinum depth of the elongate cavity 66 is approximately equal to the radius of the cylindrical charge 30.

The upper mold 64, which resembles a slab, has two elongate protrusions 68 of semi-circular cross section, corresponding to each elongate cavity 66, formed on the contacting surface 70 of the upper mold 64. A molten slurry (not shown), such as Pentolite or Cyclotol, is poured into each elongate cavity 66 of the cast mold 62. The upper mold 64 is then positioned on top of the cast mold 62 as illustrated in FIG. 3, such that the elongate protrusions 68 engage the molten slurry (not shown) in the center of the elongate cavity 66. The elongate protrusions 68 of the upper mold 64 form the channels 42 in the cast segment 32.

Figure 5:
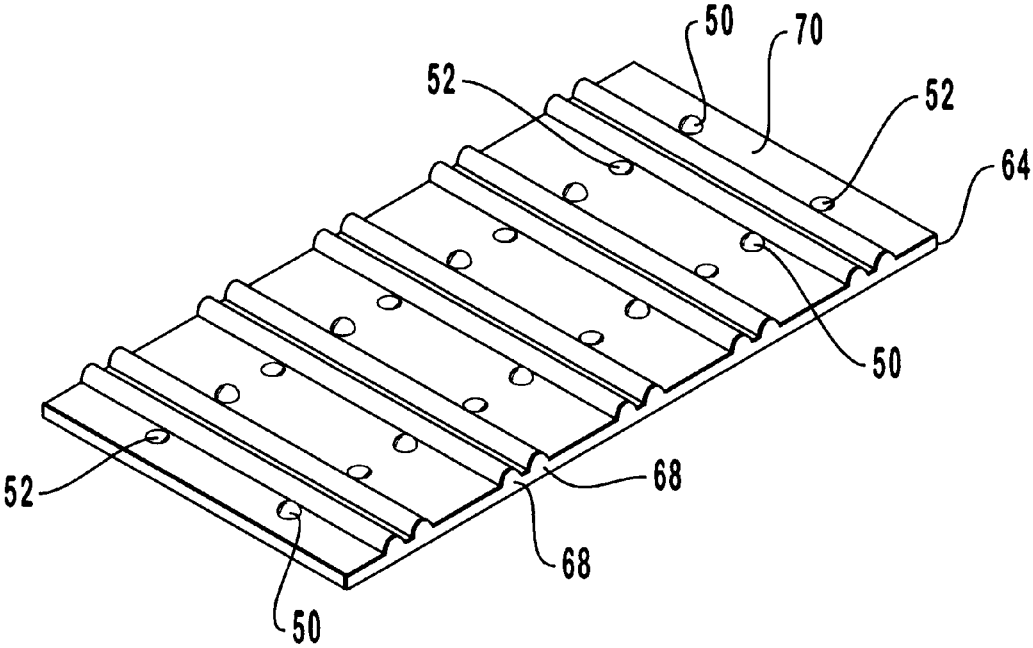
FIG. 5 is a perspective view of the upper mold.

As illustrated in FIG. 5, the contacting surface 70 of the upper mold 64 further includes two male nodules 50 and two female recesses 52, corresponding to each elongate cavity 66.

The contacting surface 70 of the upper mold 64 may also have, for example, a hatch mark design (not shown) formed thereon. Once the upper mold 64 engages the molten slurry (not shown), the corresponding hatch mark design 72, as shown in FIG. 6, may be formed on the flat surface 34 of the cast segment 32. It is understood, however, that any texturing or alternatively hatch-mark design (not shown), if any, may be formed into or onto the flat surface 34 of the cast segment 32. Likewise, any suitable indicia (e.g., design, logo, product identification, or label) may be formed into or onto the curved surface 36 of the cast segment 32, by appropriate modification to the cast mold 62.

The molten slurry (not shown), confined between the set of molds 60, solidifies into the cast segment 32 after being sufficiently cooled. The upper mold 64 is then disengaged (removed) from both the cast mold 62 and the cast segment 32.

Figure 7:
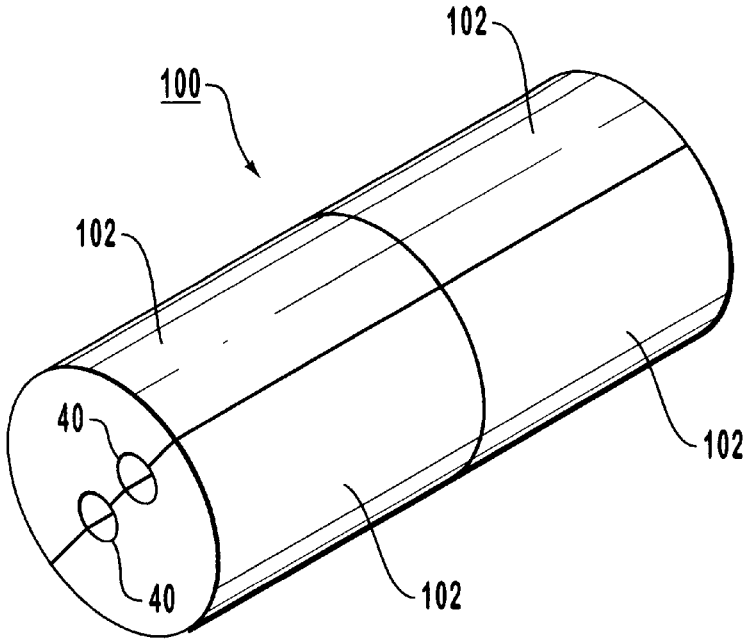
FIG. 7 is a perspective view of an alternative embodiment of the cylindrical cast explosive charge.

In one alternative embodiment, a second cylindrical charge 100 is formed of four identical half segments 102 (halves of a cast segment 32) as shown in FIG. 7. These half segments 102 may be produced by cutting the solidified cast segment 32 in half, midway between the ends of the cast segment 32, with an appropriate saw. These half segments 102 may also be produced by simply positioning a thin mold wall (not shown) in the elongate cavity 66, perpendicular to the axis of the elongate cavity 66 and midway between the ends of the elongate cavity 66. This latter process merely involves a minor alteration to the cast mold 62.

Figure 8:
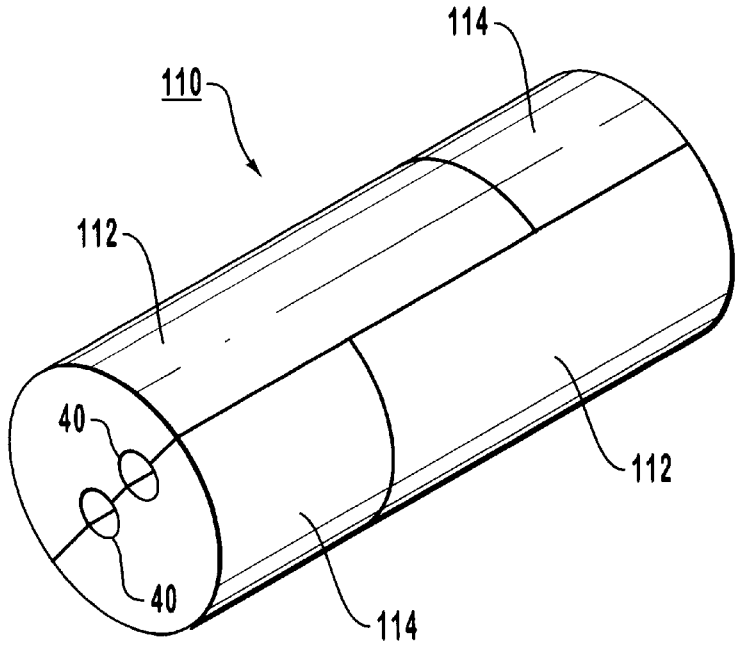
FIG. 8 is a perspective view of another alternative embodiment of the cylindrical cast explosive charge.

In other alternative embodiments, the cast segment 32 may further be divided into any suitable number of shorter sections or discs (not shown). The manufacturing method of the present invention may also be utilized to form more complex combinations. In one embodiment, a third cylindrical charge 110, illustrated in FIG. 8, requires only that a thin mold wall (not shown) be positioned widthwise in the elongate cavity 66 at a position other than midway between the ends of the elongate cavity 66. In this embodiment, large segments 112 and small segments 114 may interlock with each other.

Figure 9:
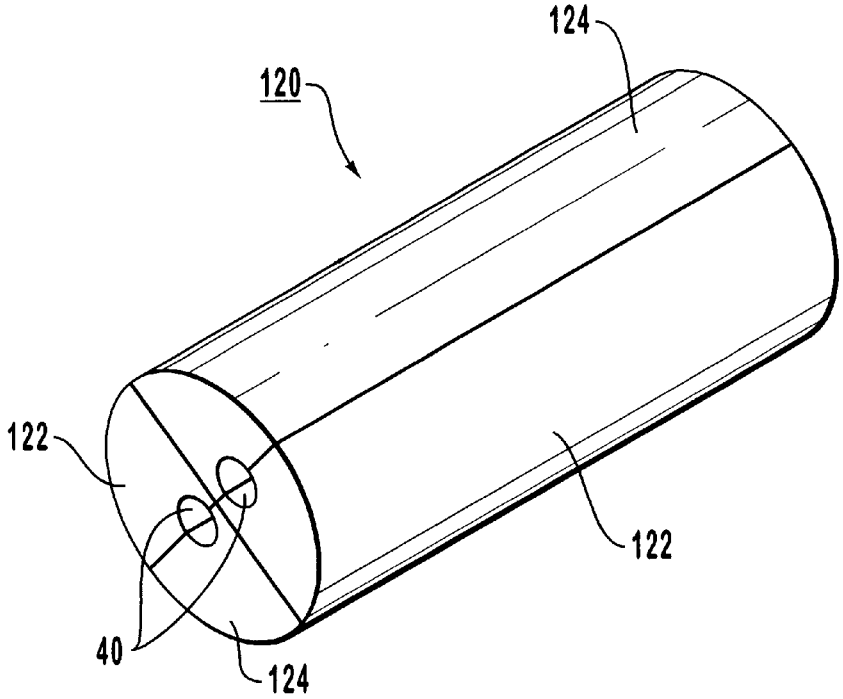
FIG. 9 is a perspective view of another alternative embodiment of the cylindrical cast explosive charge.

In like manner, a fourth cylindrical charge 120, as illustrated in FIG. 9, may be formed of four elongate sections 122 and 124 (two each). These four elongate sections 122 and 124 may be formed by positioning a thin mold wall (not shown) in the elongate cavity 66 along the axis of the elongate cavity 66. In this way, each elongate cavity 66 produces both elongate sections 122 and 124.

Figure 10:
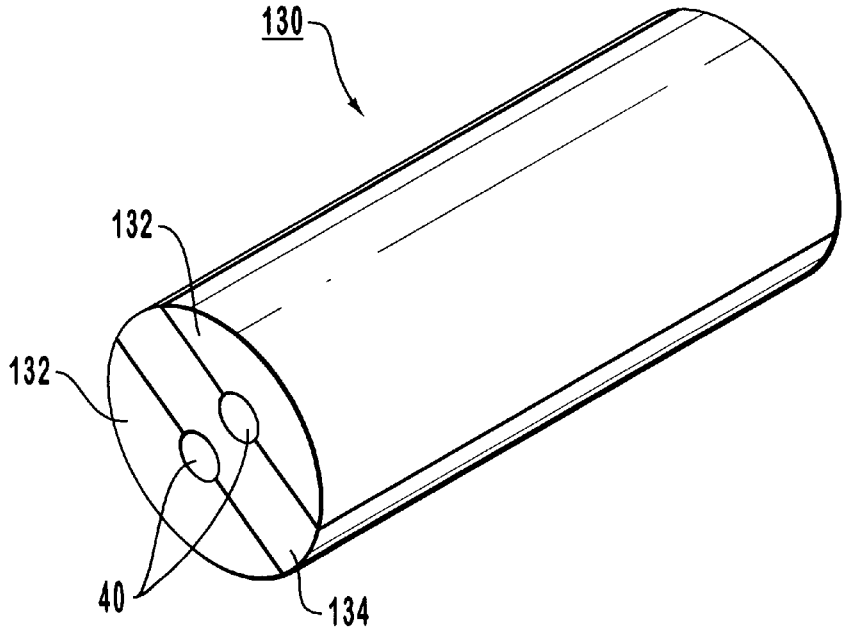
FIG. 10 is a perspective view of another alternative embodiment of the cylindrical cast explosive charge.

By way of example, FIG. 10 illustrates a fifth cylindrical charge 130 formed of two sandwich segments 132 and one center segment 134. This embodiment requires the use of two different sets of modified molds (not shown): one set for the sandwich segments 130, and one set for the center segment 134. It should be clear that the improved manufacturing method of the present invention provides great flexibility in configuring alternative cylindrical cast charges, thereby producing various desired explosive properties. In each of the multi-segmented explosive charges, interfaces having the characteristics described above are defined at the abutments of adjacent segments.

Figure 11:
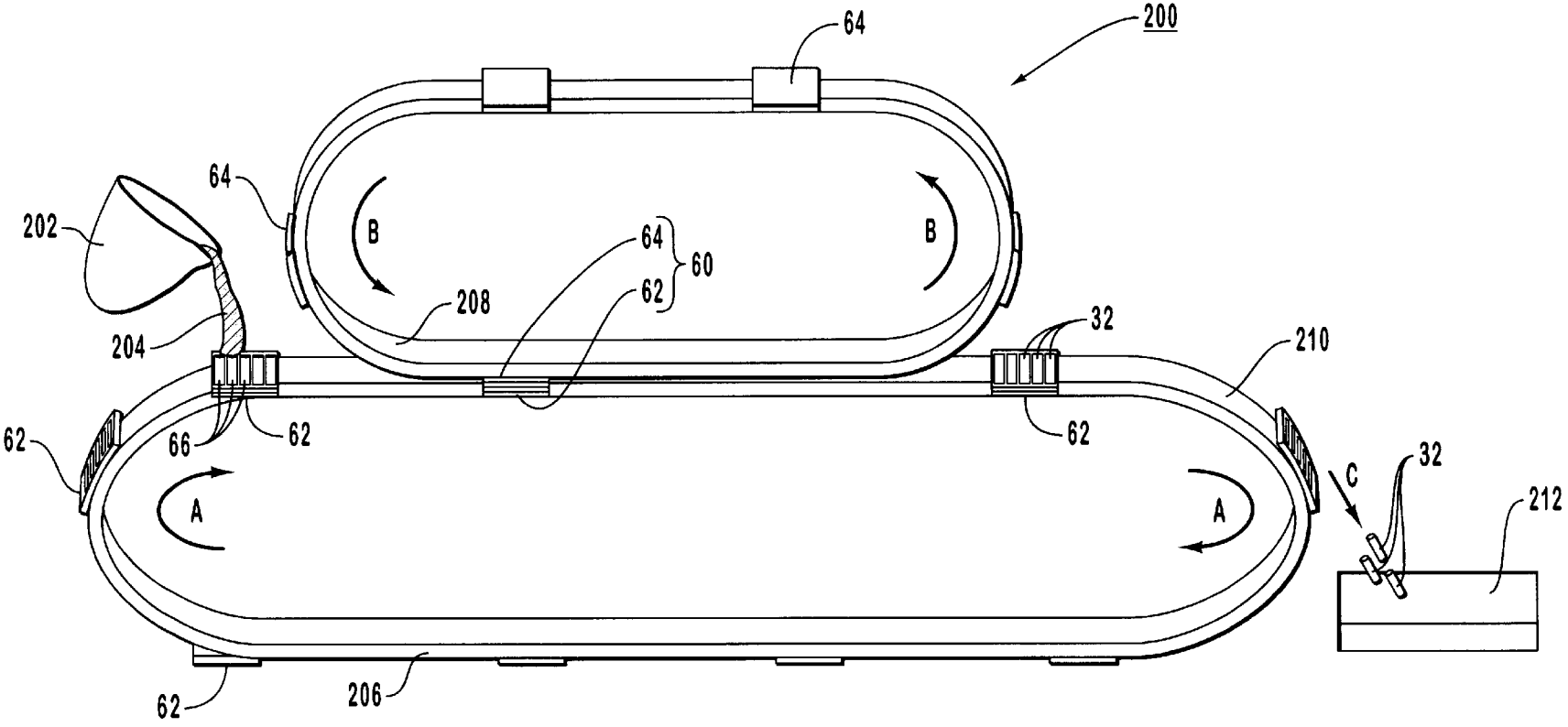
FIG. 11 is a diagram of the manufacturing process.

One embodiment of the manufacturing method 200 is illustrated generally at FIG. 11. A dispensing mechanism 202 is used for storing and pouring the molten slurry 204 into the elongate cavities 66 of the cast molds 62. The cast molds 62 are positioned on a first conveyor assembly 206 that rotates in a direction A indicaated by arrows. The upper molds 64 are positioned on a second conveyor assembly 208, positioned above the first conveyor assembly 206 that cooperatingly rotates in a direction B indicated by arrows, whereby individual of upper molds 64 operationally engage corresponding individual ones of cast molds 62 containing molten slurry 204 together forming a set of molds 60 as shown. After the molten slurry 204 has solidified into cast segments 32, the upper molds 64 are disengaged from the cast molds 62, and the cast segments 32 are then removed from the cast molds 62. The cast segments 32, in the preferred embodiment, are discharged from the cast molds 62 as shown by arrow C, once the cast mold 62 is deformed as a result of its rotation in direction A about the end loop 210 of the first conveyor assembly 206. The cast segments 32 may be collected in the receiver 212 or transferred, for example, to a third conveyor assembly (not shown), where they may be subsequently combined into cylindrical charges 30.

Figure 12:
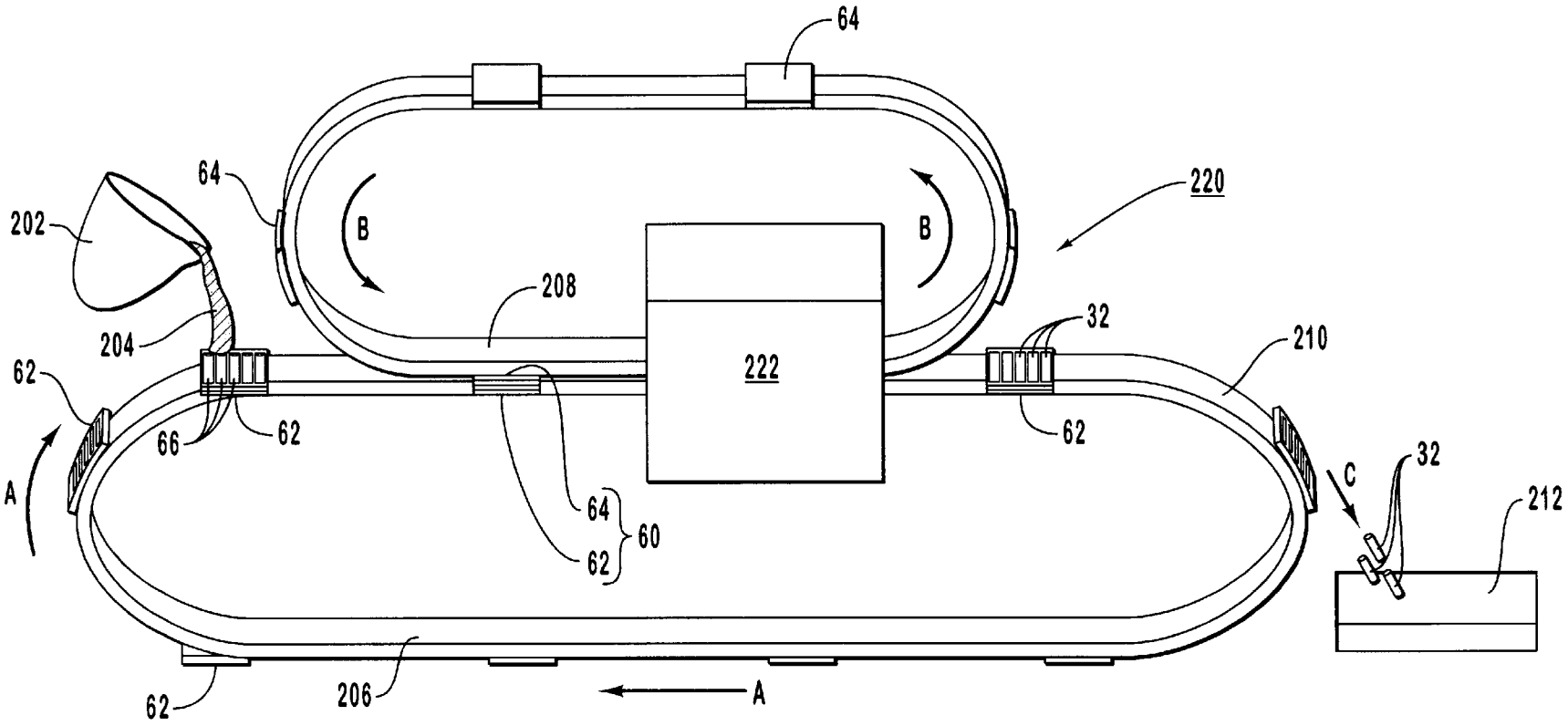
FIG. 12 is a diagram of an alternative embodiment of the manufacturing process, illustrating the use of a cooling chamber.

A second manufacturing method 220 in accordance with the present invention is illustrated at FIG. 12. A cooling chamber 222 is used to facilitate the solidification process. In this embodiment, the set of molds 60 pass through the cooling chamber 222 after the upper mold 62 engages the cast mold 64 during the solidification process. Alternatively, the second manufacturing method 220 may be operated entirely within a larger refrigeration chamber (not shown).

As illustrated in FIGS. 11 and 12, the cast molds 62 and upper molds 64 are positioned spacedly apart from one another; however, the cast molds 62 and upper molds 64 may be placed adjacent one another in a continuous supply along the first conveyor assembly 206 and second conveyor assembly 208, respectively.

Figure 13:
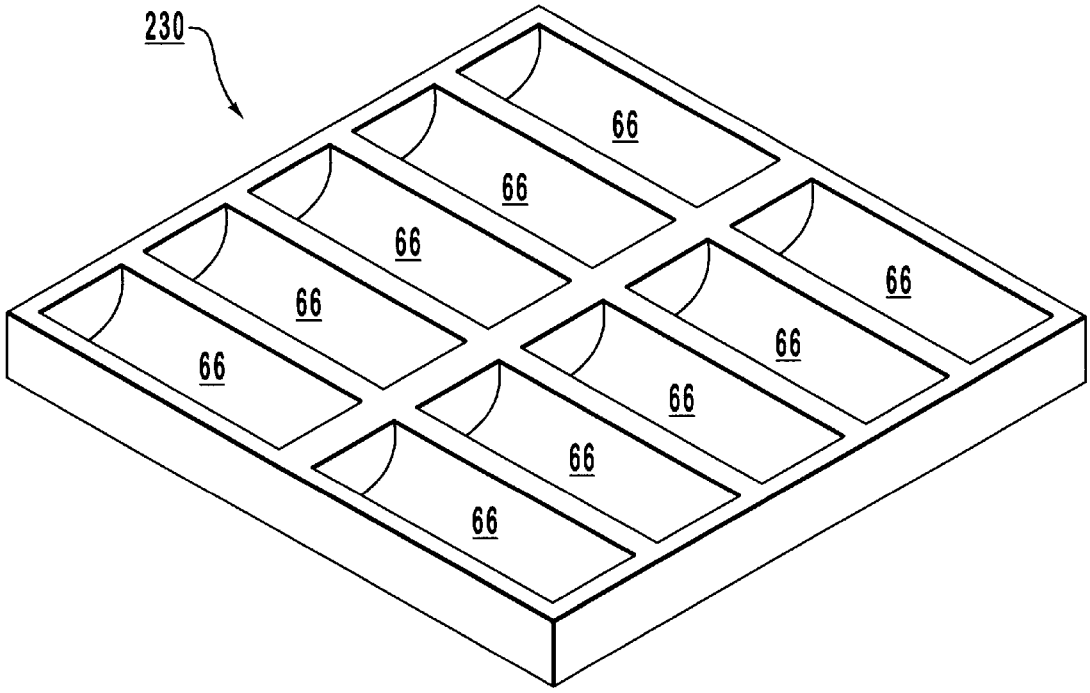
FIG. 13 is a perspective view of an alternative embodiment of the cast mold, illustrating two sets of elongate cavities abreast one another.

The cast molds 62 may be positioned on the first conveyor assembly 206 abreast one another. In like manner, a modified cast mold 230 (or set of cast molds 62) may contain a number of elongate cavities 66 abreast one another, as illustrated in FIG. 13. Modified upper molds (not shown) in this configuration would also be placed abreast one another in correspondingly equal numbers.

The cast segments 32 are collected from the receiver 212 and combined to form the cylindrical charge 30. In the preferred embodiment, the cast segments 32 have male nodules 50 and female recesses 52 which matingly engage each other when combined together to form a cylindrical charge 30. However, mating of male nodules 50 and female recesses 52 is not necessary, particularly when the cast segments 32 are attached together.

Figure 14:
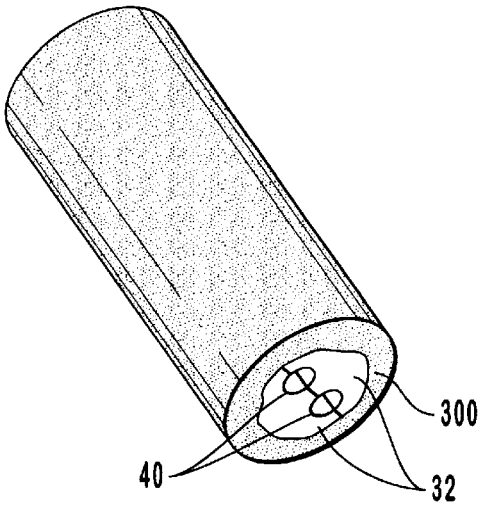
FIG. 14 is a perspective view of the cylindrical charge illustrating attachment means.
Figure 15:
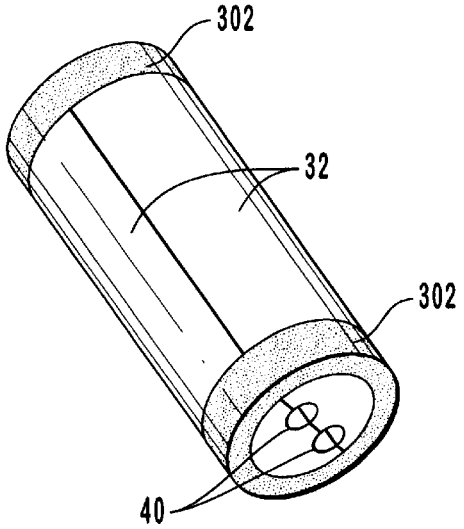
FIG. 15 is a perspective view of the cylindrical charge illustrating an alternative attachment means.

In the preferred embodiment, the cast segments 32 are further attached together with shrink wrap 300 as illustrated in FIG. 14. Alternatively, or in addition to the shrink wrap 300, end caps 302 may be used to attach the cast segments 32 together, as illustrated in FIG. 15. The end caps 302 may be formed from any suitable material, such as rubber, plastic, cardboard, paper, metal, or the like. The end caps 302 may even be formed from the same molten slurry 204 as used to form the cylindrical charge 30.

Figure 16:
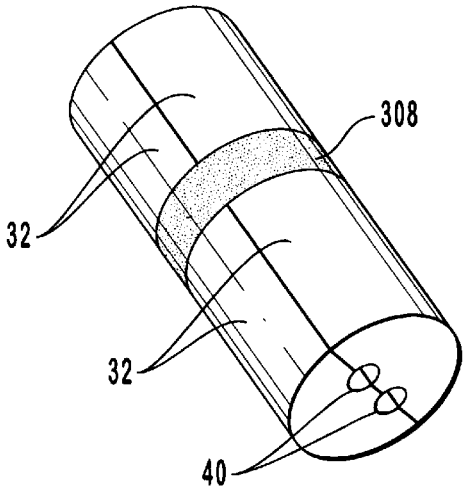
FIG. 16 is a perspective view of the cylindrical charge illustrating another alternative attachment means.
Figure 17:
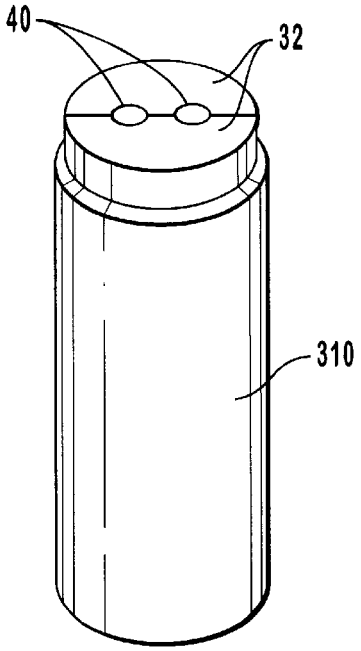
FIG. 17 is a perspective view of the cylindrical charge illustrating yet another alternative attachment means.

Referring to FIG. 16, at least one band 308 may be used to attach the cast segments 32 together. The band 308 may be formed from any suitable material, such as rubber, plastic, cardboard, paper, metal, string or other textile, tape, or the like. The cast segments 32 may alternatively be attached together by inserting them into a cardboard container 310, as illustrated in FIG. 17. It is to be understood that any suitable tube or sleeve (not shown) would also be appropriate. The container 310, or a tube or sleeve in lieu thereof, may be formed from any suitable material, such as rubber, plastic, cardboard, paper, metal, cloth, glass, or the like.

Characteristics of the described and illustrated embodiments are intended for illustrative purposes, and are not to be considered limiting or restrictive. It is to be understood that various adaptations and modifications may be made by those skilled in the art to the embodiments illustrated herein without departing from the spirit and scope of the invention, as defined by the following claims thereof.

What is claimed is:

1. An explosive charge comprising:

(a) a first explosive charge segment comprised of an explosive material, said first explosive charge segment having an exterior surface defining a first abutment surface, said first abutment surface further including a male nodule;

(b) a second explosive charge segment comprised of an explosive material, said second explosive charge segment having an exterior surface defining a second abutment surface, said second abutment surface including a female recess, said male nodule being matingly recieved in said female recess when said first abutment surface engages said second abutment surface; and (c) assembly means for securing said first explosive charge segment to said second explosive charge segment with said male nodule of said first abutment surface received in said female recess of said second abutment surface.

2. The explosive charge of claim 1, wherein an interface region is defined between said first abutment surface and said second abutment surface when said first explosive charge segment is secured to said second explosive charge segment by said assembly means, said interface region defining a plurality of voids which extend from the periphery of said interface region a distance along said interface region.

3. The explosive charge of claim 2, wherein said interface region is oriented parallel to a longitudinal axis extending across the largest cross-sectional dimension of said explosive charge.

4. The explosive charge of claim 2, wherein said interface region is oriented coplanar with a longitudinal axis extending across the largest cross-sectional dimension of said explosive charge.

5. The explosive charge of claim 1, wherein an interface region is defined between said first abutment surface and said second abutment surface when said first explosive charge segment is secured to said second explosive charge segment by said assembly means, which defines a void which extends from the periphery of said interface region a distance along said interface region, said interface region communicating with said first exterior surface and said second exterior surface.

6. The explosive charge of claim 5, wherein said interface extends through the full width of said explosive charge.

7. The explosive charge of claim 5, wherein said interface extends through the full height of said explosive charge.

8. The explosive charge of claim 5, wherein said interface extends through the full depth of said explosive charge.

9. The explosive charge of claim 1, wherein said first explosive charge segment comprises a cast explosive.

10. The explosive charge of claim 1, wherein said first abutment surface and said second abutment surface are planar.

11. The explosive charge of claim 1, wherein each of said first explosive charge segment and said second explosive charge segment is comprised of substantially similar explosive materials.

12. The explosive charge of claim 10, wherein said first explosive charge segment and said second explosive charge segment are each elongate and substantially semicircular in cross section.

13. The explosive charge of claim 1, wherein said first explosive charge segment and said second explosive charge segment each comprise an elongate section having a substantially semicircular, wherein said explosive charge is substantially cylindrical.

14. The explosive charge of claim 13, wherein said substantially cylindrical segmented explosive charge defines a void between said first explosive charge segment and said second explosive charge segment.

15. The explosive charge of claim 14, wherein said substantially cylindrical segmented cast explosive charge defines two voids.

16. The explosive charge of claim 1, wherein said first explosive charge segment defines a void between said first explosive charge segment and said second explosive charge segment.

17. The explosive charge of claim 1, wherein each of said first explosive charge segment and said second explosive charge segment is comprised of a cast explosive.

18. The explosive charge of claim 1, wherein one of said first abutment surface and said second abutment surface comprises texturing.

19. The explosive charge of claim 1, wherein said first explosive charge segment includes indicia on said first exterior surface other than on said first abutment surface.

20. The explosive charge of claim 1, wherein said assembly means comprises any one of tape, end caps, bands, adhesive, tubing, containers, string, pre-made labels, textile material, and coatings.

21. The explosive charge of claim 1, wherein said assembly means comprises shrink wrapping.

22. The explosive charge of claim 21, wherein said assembly means further comprises fitted end caps.

23. The explosive charge of claim 1, wherein each of said first explosive charge segment and said second explosive charge segment is comprised of pentolite.

24. The explosive charge of claim 1, wherein each of said first explosive charge segment and said second explosive charge segment is comprised of a material selected from the group consisting of pentaerythritol tetranitrate, trintrotoluene, cyclotol, cyclonite, amatex, kalatol, tritonal, tetrytol, baratol, and baronal.

25. The explosive charge of claim 21, wherein said assembly means further comprises an adhesive.

26. An explosive charge comprising:

a. a first explosive charge segment comprised of an explosive material, said first explosive charge segment having an exterior surface defining a first abutment surface;

b. a second explosive charge segment comprised of an explosive material, said second explosive charge segment having an exterior surface defining a second abutment surface;

c. male-female mating means associated with said first abutment surface and said second abutment surface for facilitating and stabilizing the disposition of said first explosive charge segment adjacent to said second explosive charge segment with said first abutment surface engaging said second abutment surface in a predetermined assembled relationship; and d. assembly means for securing said first explosive charge segment to said second explosive charge segment with said first abutment surface engaging said second abutment surface in said predetermined relationship.

27. An explosive charge as recited in claim 26, wherein said male-female mating means comprises:

a. a male nodule projecting from said first abutment surface; and b. a female recess formed in said second abutment surface, said male nodule being received in said female recess when said first abutment surface engages said second abutment surface in said predetermined assembled relationship.

28. An explosive charge as recited in claim 27, wherein the configuration of said male nodule is substantially similar to the configuration of said female recess.

29. An explosive charge as recited in claim 28, wherein said male nodule is semispherical.

30. An explosive charge as recited in claim 28, wherein said male nodule is cylindrical.

31. An explosive charge as recited in claim 28, wherein the shape of said male nodule comprises any one of a disc, a square, a star, a triangle, a rectangle, or a cross.

32. An explosive charge as recited in claim 27, wherein said mating means further comprises:

a. a female recess formed in said first abutment surface; and b. a male nodule projecting from said second abutment surface.

33. An explosive charge segment as recited in claim 32, wherein a channel is formed in said first abutment surface, and said male nodule projecting from said first abutment surface and said female recess formed in said first abutment surface are on opposite sides of said channel.

* * * * *

UNITED STATES PATENT AND TRADEMARK OFFICE

CERTIFICATE OF CORRECTION

PATENT NO. : 5,959,237
DATED : September 28, 1999
INVENTOR(S) : Roger B. Clement It is certified that error appears in the above-identified patent and that said Letters Patent is hereby corrected as shown below:

Column 7,
Line 34, change "ascertlined" to -- ascertained --;

Column 8,
Line 27, delete "5";

Column 10,
Line 33, change "indicaated" to -- indicated; and
Line 35, after "208" delete the comma (",").

CLAIMS:

Claim 12,
Line 1, change "10" to -- 1 --.

Claim 13,
Line 4, after "semicircular" insert -- cross section --; and
Line 5, before "substantially" insert -- a --; and after "cylindrical" insert -- segmented cast explosive charge --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*